US005194355A

United States Patent [19]

Ohmura et al.

[11] Patent Number: 5,194,355

[45] Date of Patent: Mar. 16, 1993

[54] ELECTROPHOTOGRAPHIC PHOTOSENSITIVE MEMBER

[75] Inventors: Satomi Ohmura, Kawasaki; Toshihiro Kikuchi, Yokohama, both of Japan

[73] Assignee: Canon Kabushiki Kaisha, Tokyo, Japan

[21] Appl. No.: 851,244

[22] Filed: Mar. 13, 1992

Related U.S. Application Data

[63] Continuation of Ser. No. 682,366, Apr. 9, 1991, abandoned.

[30] Foreign Application Priority Data

Apr. 10, 1990 [JP] Japan ..... 2-93072

[51] Int. Cl.[5] ..... G03G 5/047; G03G 5/06

[52] U.S. Cl. ..... 430/58; 430/76; 430/77; 355/277; 358/401

[58] Field of Search ..... 430/73, 76, 77, 58; 358/400, 401; 355/277

[56] References Cited

U.S. PATENT DOCUMENTS 4,737,430 4/1988 Kinoshita et al. ..... 430/59
4,830,944 5/1989 Umehara et al. ..... 430/76
4,999,269 3/1991 Emoto et al. ..... 430/76
5,034,294 7/1991 Go et al. ..... 430/76
5,055,367 10/1991 Law ..... 430/76

FOREIGN PATENT DOCUMENTS 0188055 7/1986 European Pat. Off. .

OTHER PUBLICATIONS

Patent Abstracts of Japan, vol. 14, No. 8 (P-987) (3951), Jan. 10, 1990.
Patent Abstracts of Japan, vol. 13, No. 543 (P-970) (3891), Dec. 6, 1989.
Patent Abstracts of Japan, vol. 9, No. 90 (P-350) (1813), Apr. 19, 1985.
Patent Abstracts of Japan, vol. 12, No. 427 (P-784) (3274), Nov. 11, 1988.

*Primary Examiner*—John Goodrow
*Attorney, Agent, or Firm*—Fitzpatrick, Cella, Harper & Scinto

[57] ABSTRACT

An electrophotographic photosensitive member has an electroconductive support and a photosensitive layer. The photosensitive layer contains a compound represented by the general formula (1) below:

$$Ar-(-N=N-Cp)_i \quad (1).$$

13 Claims, 1 Drawing Sheet

ELECTROPHOTOGRAPHIC PHOTOSENSITIVE MEMBER

This application is a continuation of application Ser. No. 07/682,366 filed Apr. 9, 1991 now abandoned.

BACKGROUND OF THE INVENTION

1. Field of the Invention

The present invention relates to an electrophotographic photosensitive member, particularly to an electrophotographic photosensitive member containing an azo pigment having a specified chemical structure.

2. Related Background Art

Known organic photoconductive substances used for electrophotographic photosensitive members include photoconductive polymers typified by poly-N-vinylcarbazole, low-molecular organic photoconductive substances such as 2,5-bis(p-diethylaminophenyl)-1,3,4-oxadiazole, combinations of such organic photoconductive substances with a variety of dyes and pigments, and so forth.

Electrophotographic photosensitive members employing an organic photoconductive substance have advantages that the photoconductive members are producible at high productivity at low cost, and the color sensitivity thereof is arbitrarily controlled by selecting the employed sensitizer such as a dye and a pigment. Therefore, organic photoconductive substances have comprehensively been investigated. Recently, function separation types of photosensitive members have been developed which have a lamination structure comprising a charge-generating layer containing an organic photoconductive dye or pigment and a charge-transporting layer containing aforementioned photoconductive polymer or a low-molecular organic photoconductive substance, whereby the disadvantages of conventional organic electrophotographic photosensitive members such as low sensitivity and low durability have been remarkably alleviated.

Among organic photoconductive substances, generally, azo pigments have superior photoconductivity. Moreover, selection of combinations of an azo component and a coupler component allows control of pigment properties, giving a variety of properties of pigment compounds. Accordingly, many azo pigments have been reported as organic photoconductive substances.

Known couplers for such azo pigments include naphthol AS type compounds as disclosed in Japanese Patent Application Laid-Open No. 47-375438, etc., benzocarbazole compounds as disclosed in Japanese Patent Application Laid-Open No. 53-95033, naphthalimide type compounds as disclosed in Japanese Patent Application Laid-Open No. 54-79632, perylene type compounds as disclosed in Japanese Patent Application Laid-Open No. 57-176055, and so forth.

SUMMARY OF THE INVENTION

It is an object of the present invention to provide an electrophotographic photosensitive member having a higher sensitivity, and stable potential characteristics during repeated use.

The present invention provides an electrophotographic photosensitive member comprising an electroconductive support and a photosensitive layer formed thereon, the photosensitive layer containing a compound represented by the general formula (1) below:

$$Ar-(-N=N-Cp)_i \quad (1)$$

where Ar is an aromatic hydrocarbon radical or an aromatic heterocyclic radical which may be substituted and may be linked through a linking group; Cp is a coupler radical having a phenolic hydroxyl radical; and i is an integer of 1, 2, 3, or 4; at least one of Cp being a coupler radical represented by the formula (2) below:

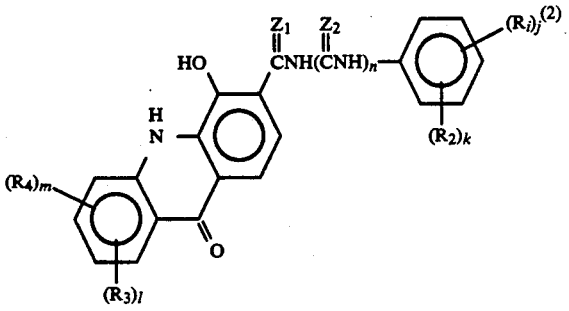

where $R_1$, $R_2$, $R_3$, and $R_4$ may be the same or different, and are respectively hydrogen, alkoxy, disubstituted amino, halogen, nitro, cyano, trifluoromethyl, substituted or unsubstituted alkyl, substituted or unsubstituted aryl, or substituted or unsubstituted aralkyl; $Z_1$ and $Z_2$ may be the same or different and are oxygen or sulfur; j and k are respectively an integer of 1, 2, 3, 4, or 5; l and m are respectively an integer of 1, 2, 3, or 4; and n is an integer of 0 or 1.

The present invention also provides an electrophotographic apparatus comprising an electrophotographic photosensitive member, a means for forming an electrostatic latent image, a means for developing the electrostatic latent image formed, and a means for transferring the image developed onto a transfer-receiving material; the electrophotographic photosensitive member comprising an electroconductive support and a photosensitive layer formed thereon, and the photosensitive layer containing a compound represented by the general formula (1) as shown above.

The present invention further provides a device unit comprising an electrophotographic photosensitive member, a charging means, and a cleaning means; the electrophotographic photosensitive member comprising a electroconductive support and a photosensitive layer formed thereon, the photosensitive layer containing a compound represented by the general formula (1) as shown above.

The present invention still further provides a facsimile machine, comprising an electrophotography apparatus and a signal-receiving means for receiving image information from a remote terminal: the electrophotography apparatus comprising an electrophotographic photosensitive member, the electrophotographic photosensitive member comprising an electroconductive support and a photosensitive layer formed thereon, the photosensitive layer containing a compound represented by the general formula (1) as shown above.

DESCRIPTION OF THE PREFERRED EMBODIMENT

Figure 1:
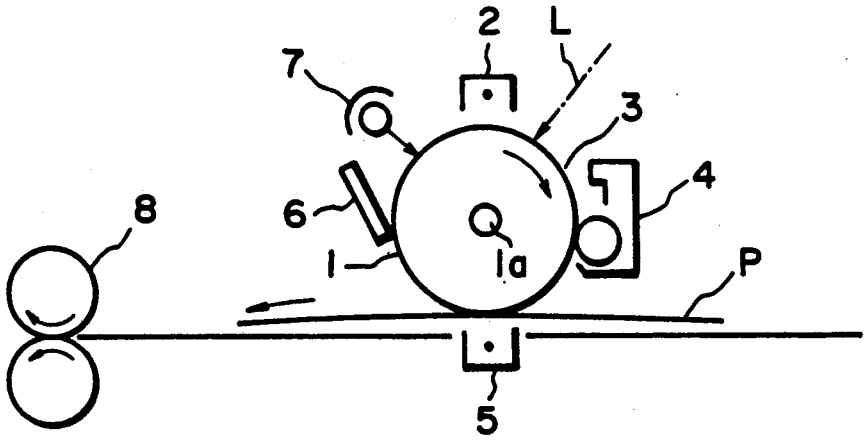
FIG. 1 illustrates an outline of the constitution of an electrophotographic apparatus employing the electrophotographic photosensitive member of the present invention.

The photosensitive layer of the electrophotographic photosensitive member of the present invention contains a compound represented by the general formula (1) below:

$$\mathrm{Ar}-(-\mathrm{N}=\mathrm{N}-\mathrm{Cp})_i \qquad (1)$$

where Ar is an aromatic hydrocarbon radical or an aromatic heterocyclic radical which may be substituted and may be linked through a linking group; Cp is a coupler radical having a phenolic hydroxyl radical; and i is an integer of 1, 2, 3, or 4; at least one of Cp being a coupler radical represented by the formula (2) below:

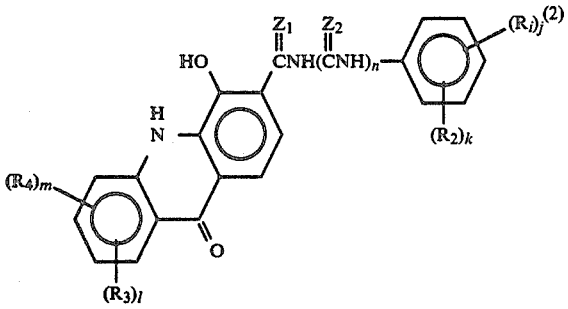

where $R_1$, $R_2$, $R_3$, and $R_4$ may be the same or different, and are respectively hydrogen, alkoxy, disubstituted amino, halogen, nitro, cyano, trifluoromethyl, substituted or unsubstituted alkyl, substituted or unsubstituted aryl, or substituted or unsubstituted aralkyl; $Z_1$ and $Z_2$ may be the same or different, and are oxygen or sulfur; j and k are respectively an integer of 1, 2, 3, 4, or 5; l and m are respectively an integer of 1, 2, 3, or 4; and n is an integer of 0 or 1.

The specific examples of Ar include radicals of aromatic hydrocarbon rings such as benzene, naphthalene, fluorene, phenanthrene, anthracene, and pyrene; radicals of heterocyclic aromatic rings such as furan, thiophene, pyridine, indole, benzothiazole, carbazole, acridone, dibenzothiophene, benzoxazole, benzotriazole, oxadiazole, and thiazole; and radicals in which the above-mentioned aromatic rings are linked directly or through an aromatic or non-aromatic group, such as triphenylamine, diphenylamine, N-methyldiphenylamine, biphenyl, terphenyl, binaphthyl, fluorenone, phenanthrene-quinone, anthraquinone, benzanthrone, diphenyloxadiazole, phenylbenzoxazole, diphenylmethane, diphenylsulfone, diphenylether, benzophenone, stilbene, distyrylbenzene, tetraphenyl-p-phenylenediamine, and tetraphenylbenzidine; and the like.

The substituent which may be possessed by the Ar includes, for example, alkyl radicals such as methyl ethyl, propyl, and butyl; alkoxy radicals such as methoxy, and ethoxy; dialkylamino radicals such as dimethylamino, and diethylamino; halogen radicals such as of fluorine, chlorine, and bromine; hydroxy, nitro, cyano, and halomethyl. cyano, and halomethyl.

The specific examples of $R_1$, $R_2$, $R_3$, and $R_4$ include alkyl radicals such as methyl, ethyl, n-propyl, and n-butyl; aryl radicals such as phenyl, naphthyl, pyrenyl, and anthryl; aralkyl radicals such as benzyl, phenethyl, and naphthylmethyl; alkoxy radicals such as methoxy, ethoxy, butoxy, and phenoxy; disubstituted amino radicals such as dimethylamino, and dietylamino; halogen radicals including radicals of fluorine, chlorine, bromine, and iodine; and the like. The groups of $R_1$, $R_2$, $R_3$, and $R_4$ are particularly preferably electron accepting radicals.

The examples of the coupler radical Cp of the formula (1) other than those represented by the general formula (2) include the coupler radicals having the structure represented by the general formulas (4) to (8), but are not limited thereto:

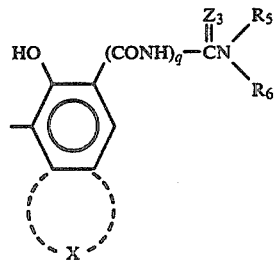

(4)

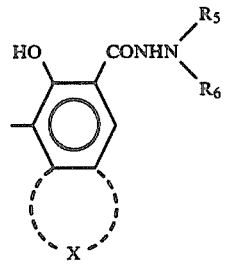

(5)

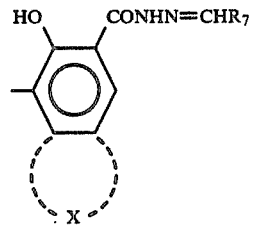

(6)

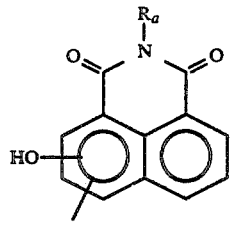

(7)

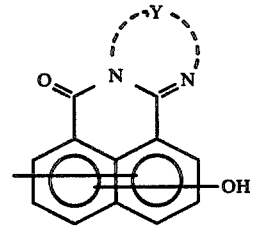

(8)

The radical X in the general formulas (4), (5), and (6) denotes a radical necessary for forming a substituted or unsubstituted ring of naphthalene, anthracene, carbazole, benzocarbazole, dibenzofuran, or the like by condensing with the benzene ring.

$R_5$ and $R_6$ are respectively a hydrogen radical, substituted or unsubstituted alkyl, substituted or unsubstituted aryl, substituted or unsubstituted aralkyl, or a substituted or unsubstituted heterocyclic ring radical, or otherwise $R_5$ and $R_6$ are linked together to form a cyclic amino group through the nitrogen atom.

$R_7$ is a hydrogen atom, substituted or unsubstituted alkyl, substituted or unsubstituted aryl, substituted or unsubstituted aralkyl, or substituted or unsubstituted heterocyclic ring radical.

$R_8$ is an alkyl radical, an aryl radical, an aralkyl radical, or a heterocyclic radical, each of which may be substituted.

$Z_3$ is oxygen or sulfur. q is an integer of 0 or 1.

Y is a bivalent aromatic hydrocarbon radical or a bivalent heterocyclic radical having a nitrogen in the ring. Specific examples are o-phenylene, o'-naphthylene, peri-naphthylene, 1,2-anthrylene, 3,4-pyrazoldiyl, 2,3-pyridindiyl, 4,5-pyridindiyl, 6,7-indazoldiyl, 6,7-quinolindiyl, and the like.

In the above description, the alkyl radical includes methyl, ethyl, propyl, butyl, etc.; the aralkyl radical includes benzyl, phenethyl, naphthylmethyl, etc.; the heterocyclic radical includes pyridyl, thienyl, furyl, thiazolyl, carbazolyl, dibenzofuryl, benzoimidazolyl, benzothiazolyl, etc.; cyclic amino group having nitrogen in the ring includes cyclic amino groups derived from pyrrol, pyrroline, pyrrolidine, pyrrolidone, indole, indoline, isoindole, carbazole, benzoindole, imidazole, pyrazole, pyrazoline, oxazine, phenoxazine, benzocarbazole, etc.

The substituent includes alkyl radicals such as methyl, ethyl, and propyl; alkoxy radicals such as methoxy and ethoxy; substituted amino radicals such as diethylamino and dimethylamino, halogen radicals of fluroine, chlorine, bromine, and iodine; a phenylcarbamoyl radical, a nitro radical; a cyano radical; halomethyl radicals such as trifluoromethyl; and the like.

Typical examples of the azo pigments useful in the present invention are listed below by showing only variable portions in the basic formula.

BASIC FORMULA 1: Ar—N=N—Cp
Exemplified pigment (1-1)
Ar:

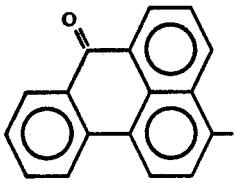

Cp:

-continued

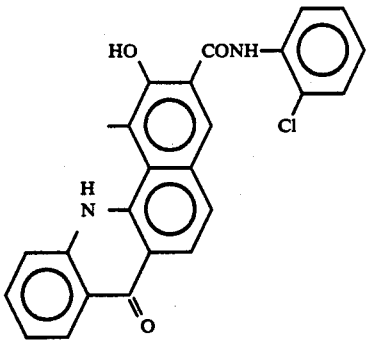

Exemplified pigment (1-2)
Ar:

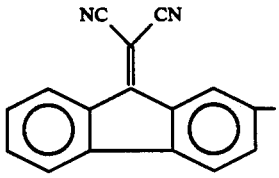

Cp:

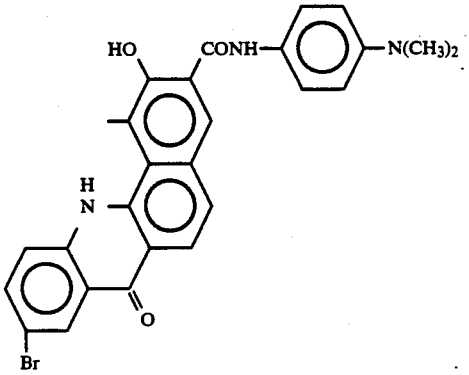

Exemplified pigment (1-3)
Ar:

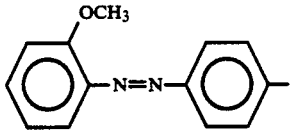

Cp:

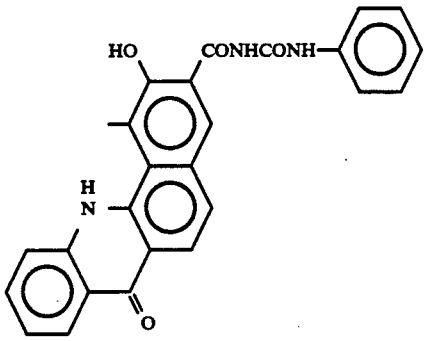

BASIC FORMULA 2: $Cp_1$—N=N—Ar—N=N—$Cp_2$
Exemplified pigment (2-1)

-continued
Ar:
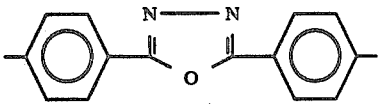
Cp1, Cp2:
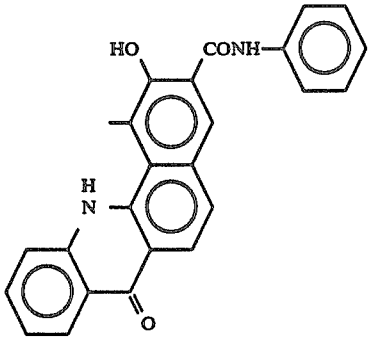
Exemplified pigment (2-2)
Ar:
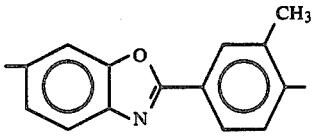
Cp1, Cp2:
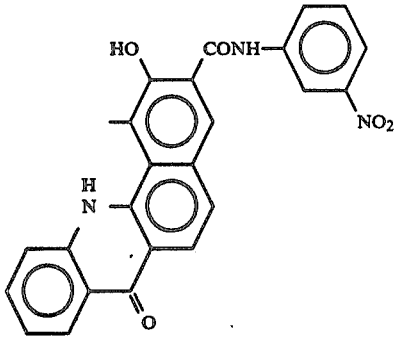
Exemplified pigment (2-3)
Ar:
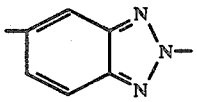
Cp1:
-continued
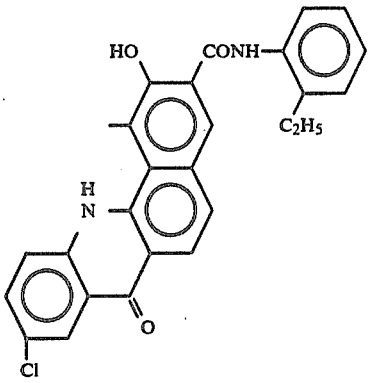
Cp2:
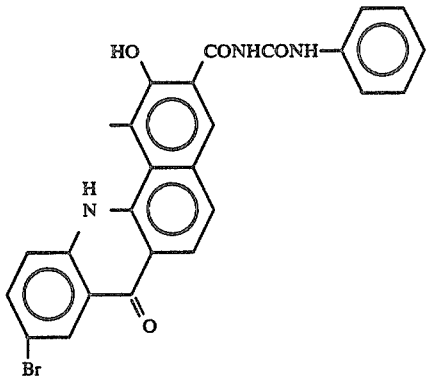
Exemplified pigment (2-4)
Ar:
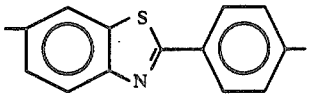
Cp1, Cp2:
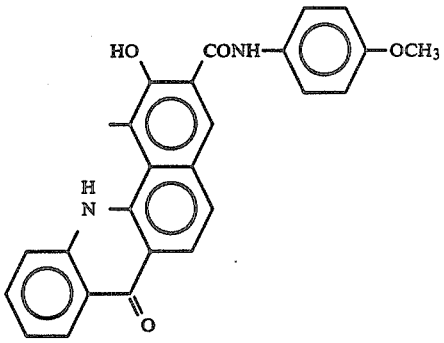
Exemplified pigment (2-5)
Ar:
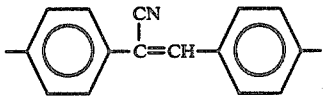
Cp1, Cp2:

-continued
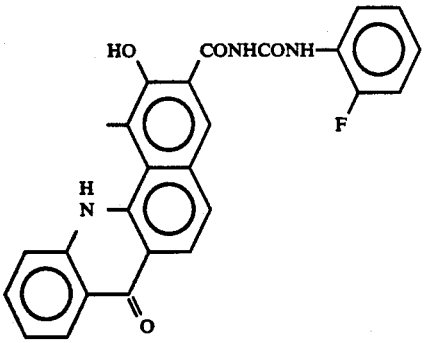
Exemplified pigment (2-6)
Ar:
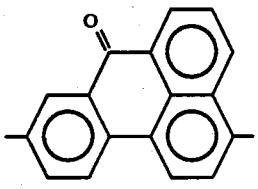
$Cp_1$:
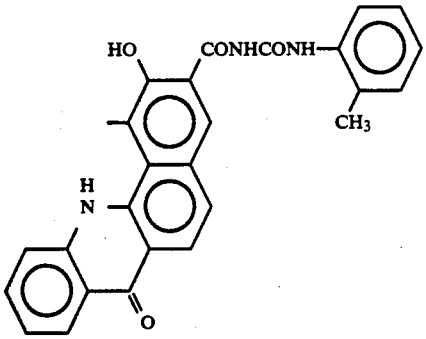
$Cp_2$:
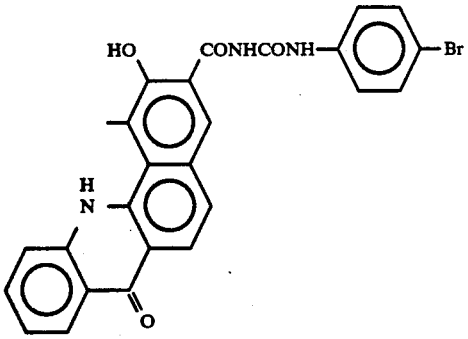
Exemplified pigment (2-7)
Ar:
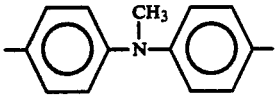
$Cp_1$, $Cp_2$:
-continued
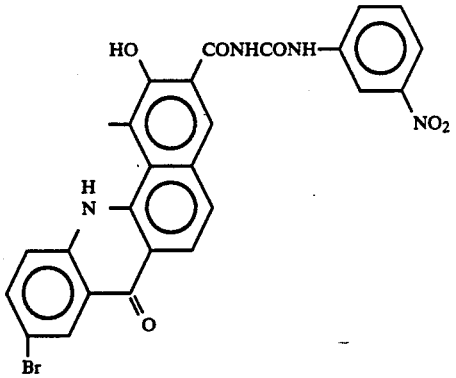
Exemplified pigment (2-8)
Ar:
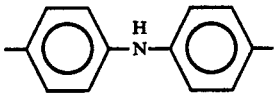
$Cp_1$:
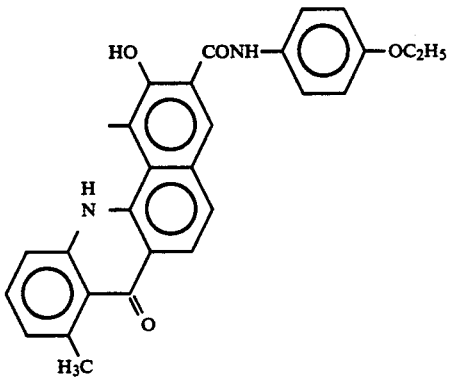
$Cp_2$:
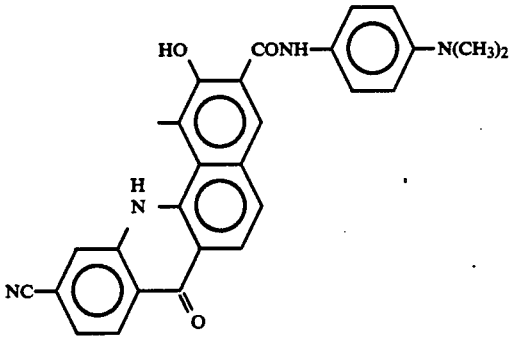
Exemplified pigment (2-9)
Ar:

-continued
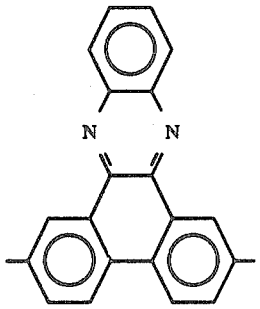
Cp1:
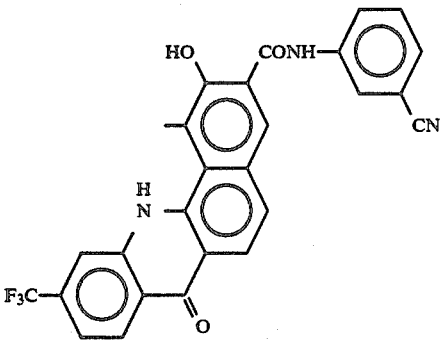
Cp2:
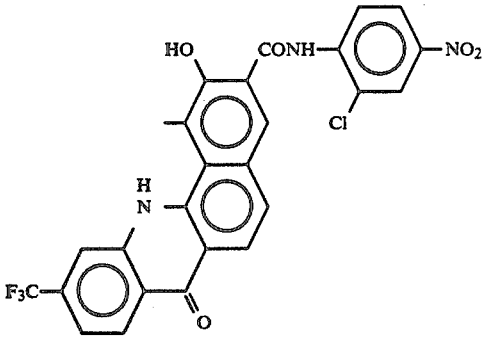
Exemplified pigment (2-10)
Ar:
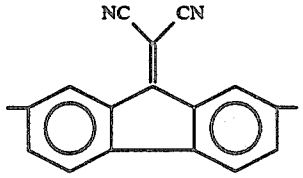
Cp1, Cp2:
-continued
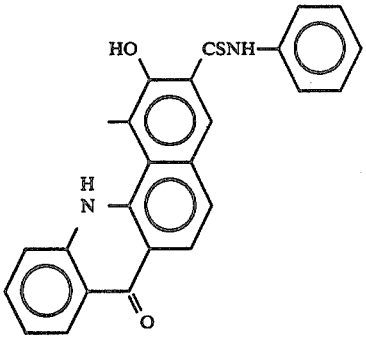
Exemplified pigment (2-11)
Ar:
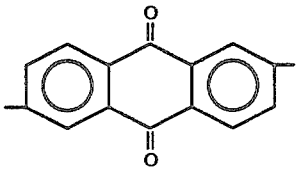
Cp1, Cp2:
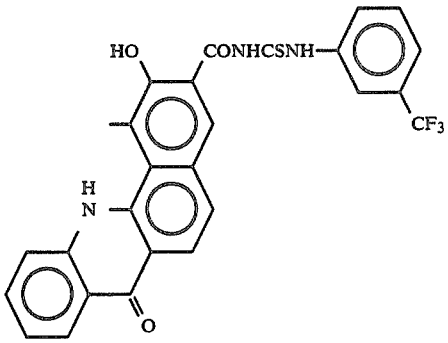
Exemplified pigment (2-12)
Ar:
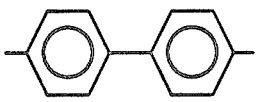
Cp1:
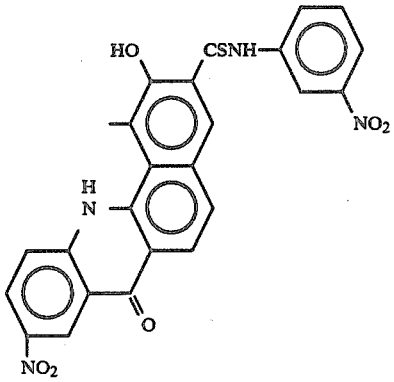
Cp2:

-continued
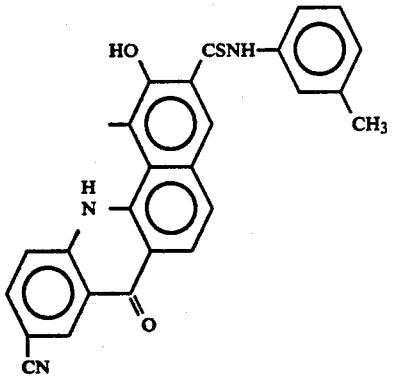
Exemplified pigment (2-13)
Ar:
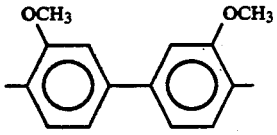
Cp1:
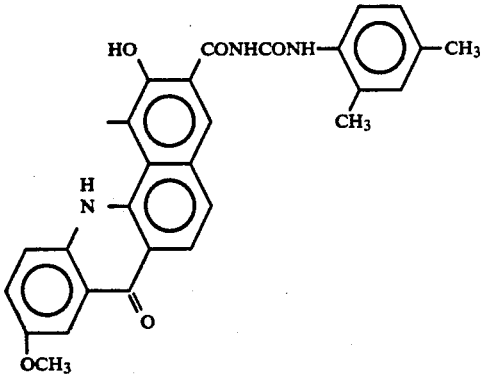
Cp2:
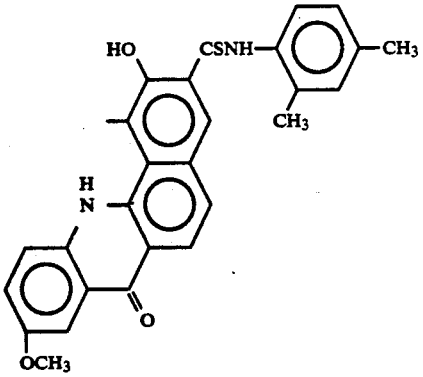
Exemplified pigment (2-14)
Ar:
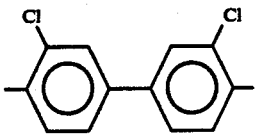
-continued
Cp1, Cp2:
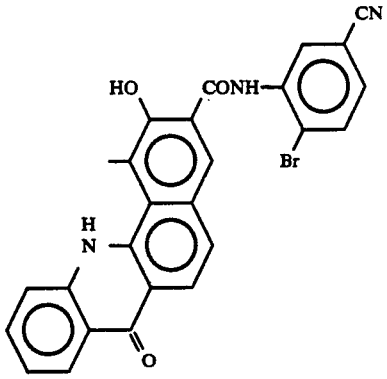
Exemplified pigment (2-15)
Ar:
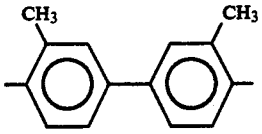
Cp1:
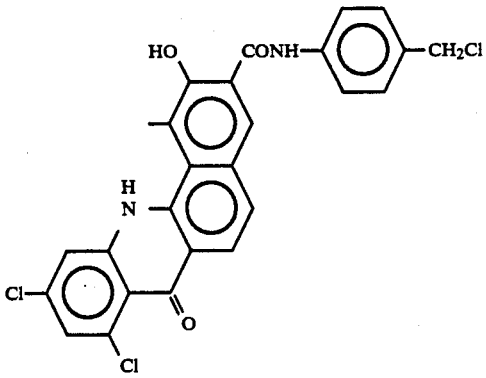
Cp2:
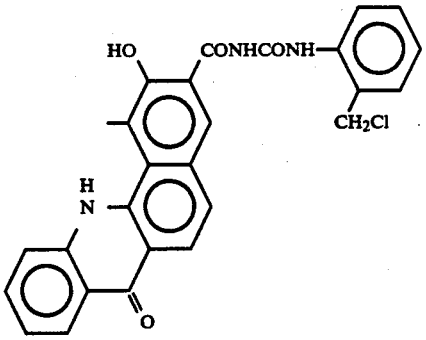
Exemplified pigment (2-16)
Ar:
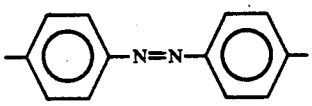
Cp1:

-continued
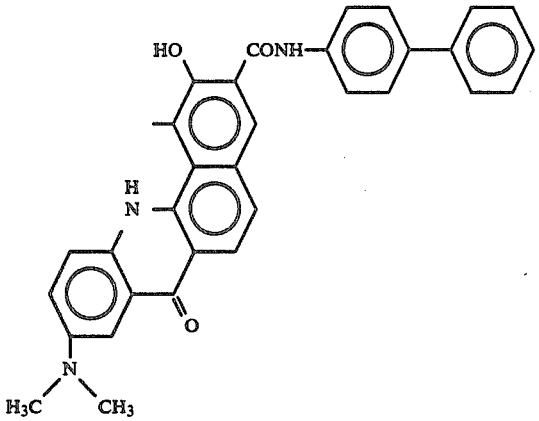
Cp2:
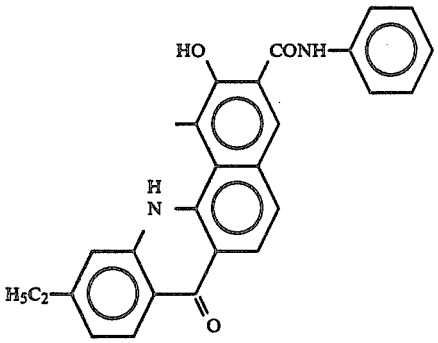
Exemplified pigment (2-17)
Ar:
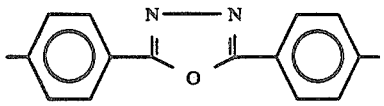
Cp1:
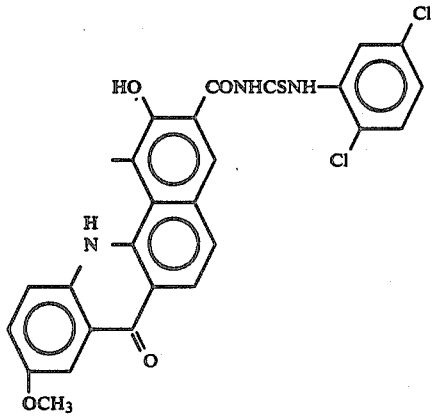
Cp2:
-continued
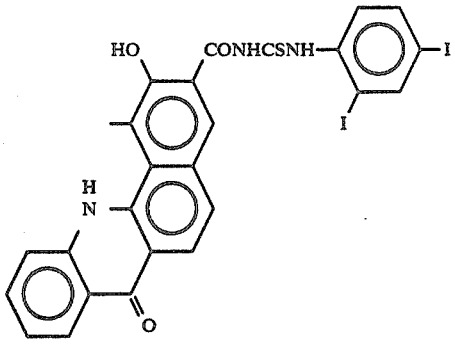
Exemplified pigment (2-18)
Ar:
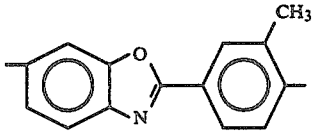
Cp1, Cp2:
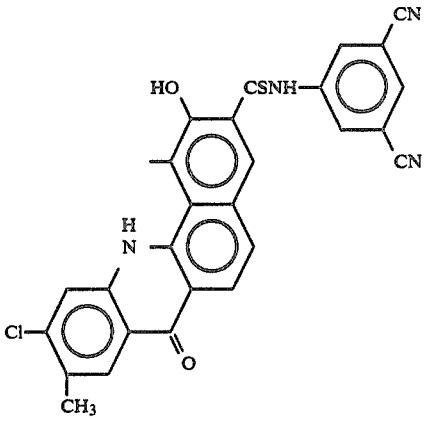
Exemplified pigment (2-19)
Ar:
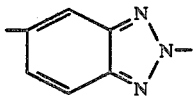
Cp1:
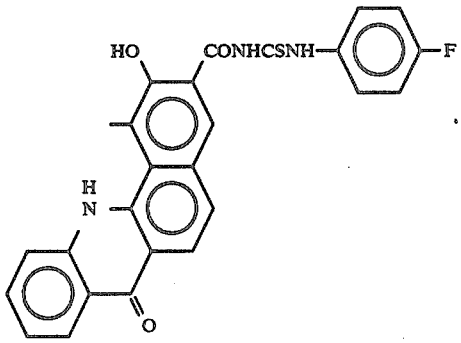
Cp2:

-continued
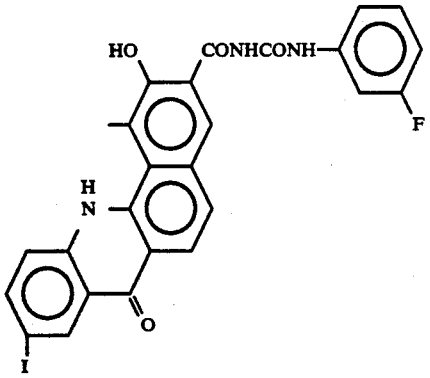
Exemplified pigment (2-20)
Ar:
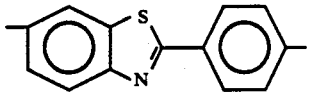
Cp1:
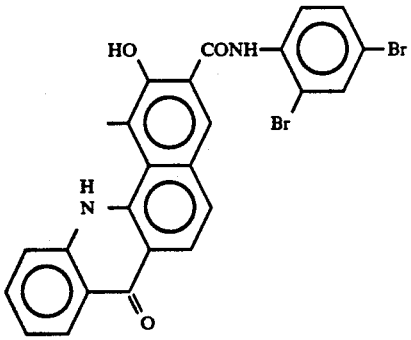
Cp2:
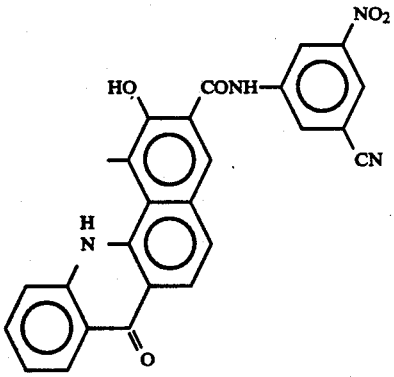
Exemplified pigment (2-21)
Ar:
-continued
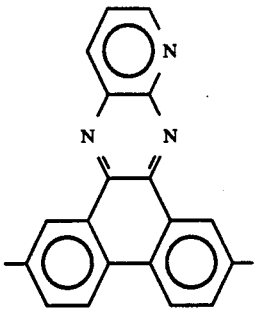
Cp1:
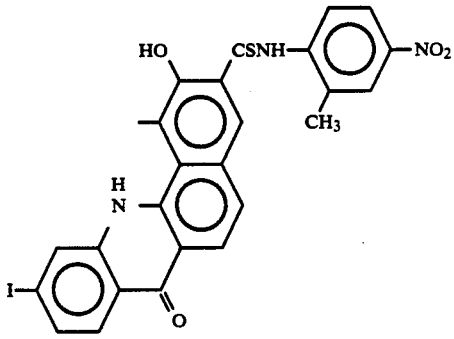
Cp2:
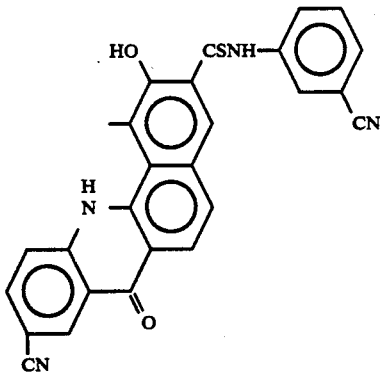
Exemplified pigment (2-22)
Ar:
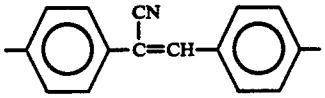
Cp1:

-continued
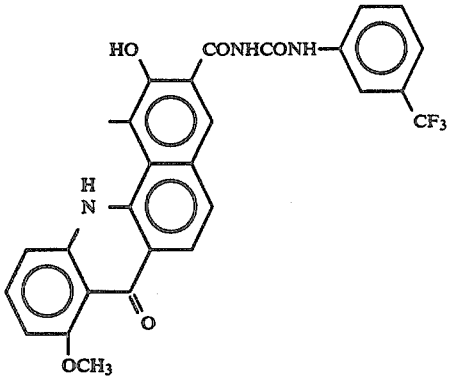
Cp2:
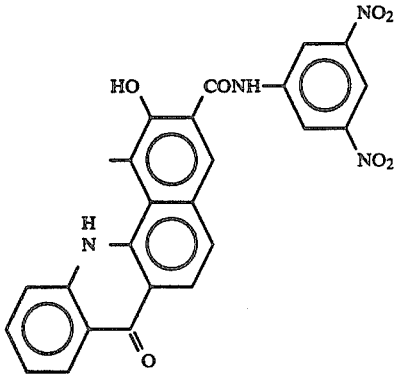
Exemplified pigment (2-23)
Ar:
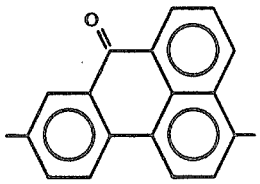
Cp1:
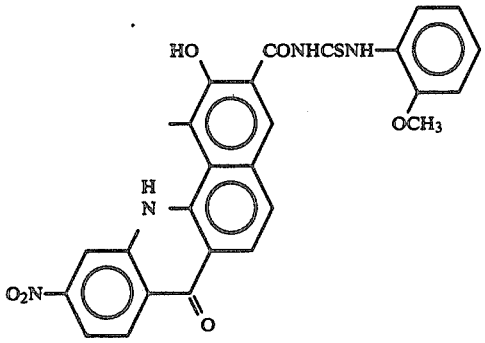
Cp2:
-continued
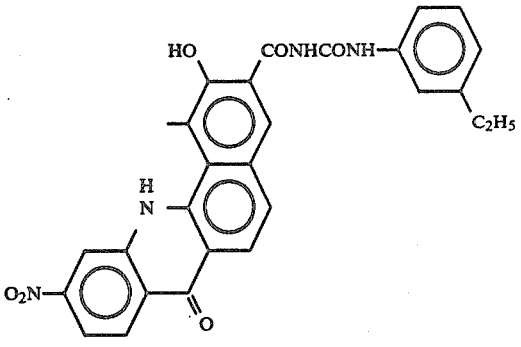
Exemplified pigment (2-24)
Ar:
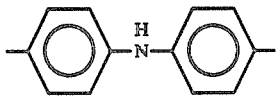
Cp1:
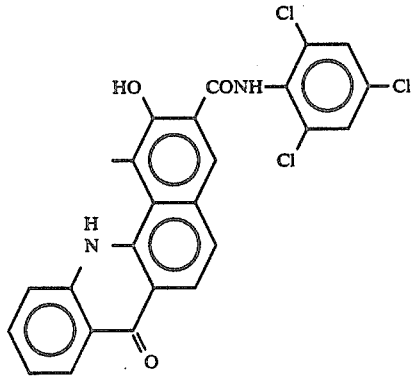
Cp2:
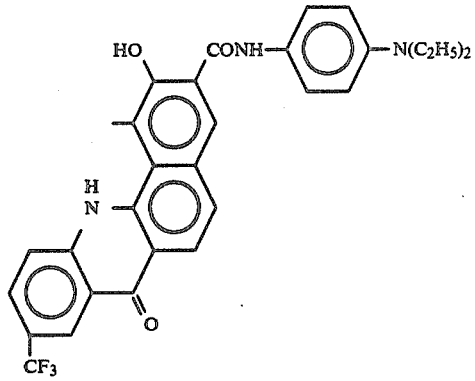
Exemplified pigment (2-25)
Ar:
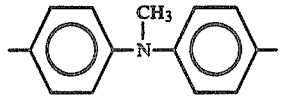
Cp1, Cp2:

-continued
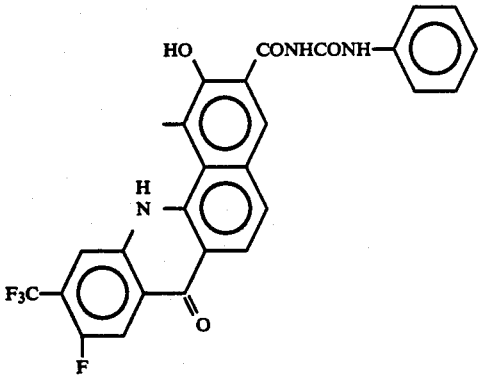
Exemplified pigment (2-26)
Ar:
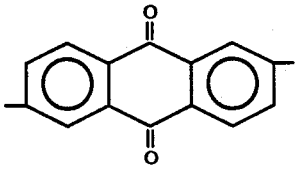
Cp1:
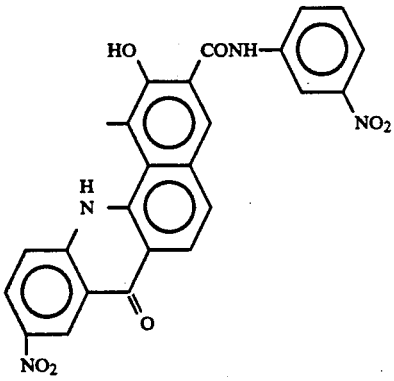
Cp2:
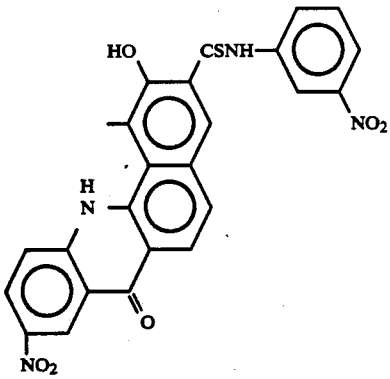
BASIC FORMULA 3:
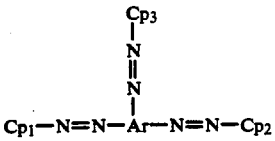
Exemplified pigment (3-1)
-continued
Ar:
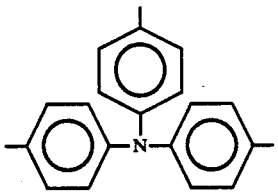
Cp1, Cp2, Cp3:
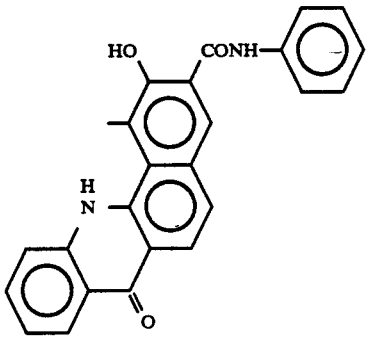
Exemplified pigment (3-2)
Ar:
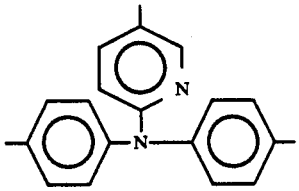
Cp1, Cp2, Cp3:
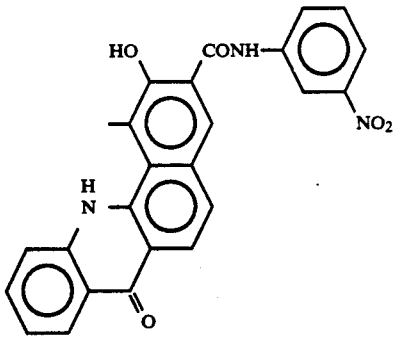
Exemplified pigment (3-3)
Ar:
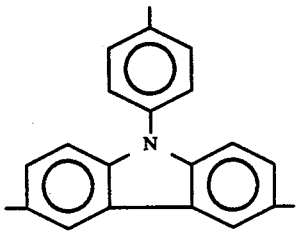
Cp1, Cp2, Cp3:

-continued
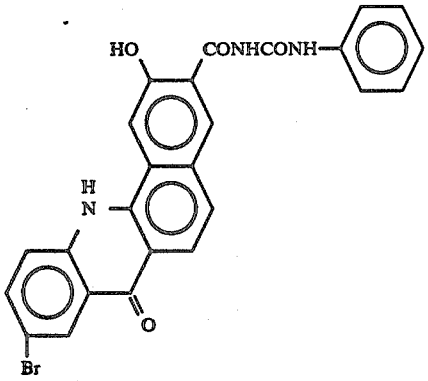
Exemplified pigment (3-4)
Ar:
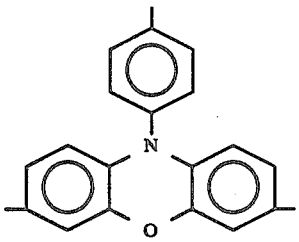
$Cp_1$, $Cp_2$, $Cp_3$:
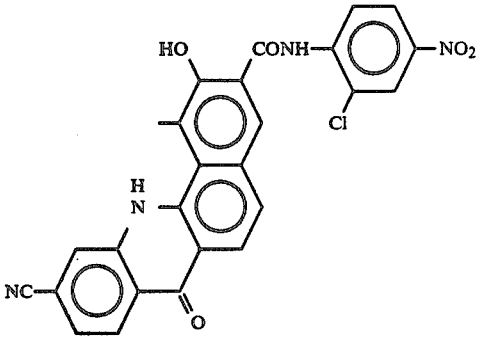
Exemplified pigment (3-5)
Ar:
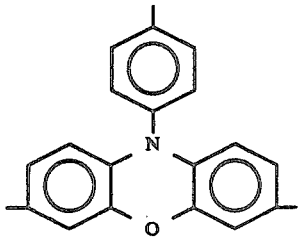
$Cp_1$, $Cp_2$, $Cp_3$:
-continued
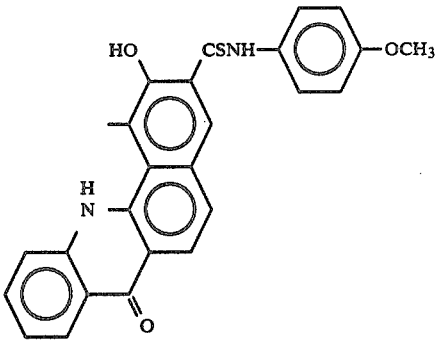
BASIC FORMULA 4: $Cp_1-N=N$, $N=N-Cp_3$, Ar, $Cp_2-N=N$, $N=N-Cp_4$
Exemplified pigment (4-1)
Ar:
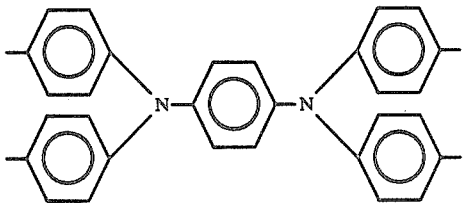
$Cp_1$, $Cp_2$, $Cp_3$, $Cp_4$:
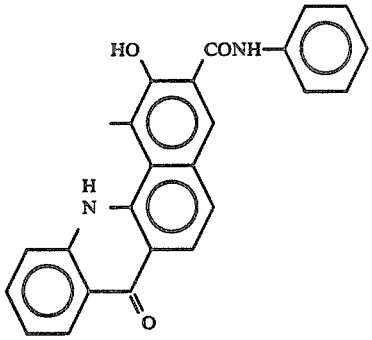
Exemplified pigment (4-2)
Ar:
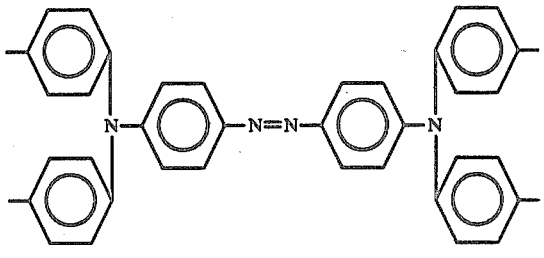
$Cp_1$, $Cp_2$, $Cp_3$, $Cp_4$:

-continued

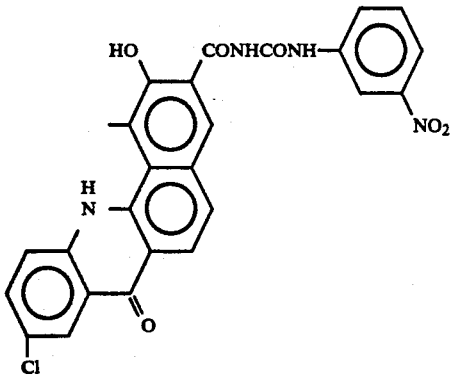

The azo pigments used in the present invention can readily be synthesized, for example, by diazotizing a corresponding amine in a conventional manner; and (a) coupling it with a coupler having the structure shown by the above general formula (2) in the presence of an alkali in an aqueous solution or otherwise (b) converting the diazonium salt to a borofluoride salt or a zinc-chloride double salt; and then coupling it with the coupler in an organic solvent such as N,N-dimethylformamide, dimethylsulfoxide, and the like in the presence of a base such as sodium acetate, triethylamine, triethanolamine, and the like.

The disazo pigments having mixedly other coupler component in addition to the one of the general formula (2) can be synthesized by tetrazotizing an equivalent mole of a corresponding diamine in a conventional manner, isolating the resulting product in a form of an aforementioned soluble salt, coupling it with an equivalent mole of a coupler of the general formula (2) and then coupling it with an equivalent mole of another coupler; or otherwise by protecting one amino group of a diamine with an acetyl radical or the like, diazotizing it, coupling it with a coupler of the general formula (2), hydrolyzing the protecting group with hydrochloric acid or the like, diazotizing it, and subsequently coupling it with another kind of coupler.

A trisazo pigment or a tetrakisazo pigment having in the molecule mixedly a coupler other than the coupler of the general formula (2) can similarly be synthesized.

Naturally, the method of the synthesis of the compounds of the present invention is not limited to the method described above.

In the present invention, the photosensitive layer, which contains the compound represented by the general formula (1), includes those of the constructions below. The constitutions are shown with the layer order of (lower layer)/(upper layer).

(1) Layer containing a charge-generating substance (charge-generating layer)/layer containing a charge-transporting substance (charge-transporting layer),
(2) Charge-transporting layer/charge-generating layer
(3) Layer containing a charge-generating substance and a charge-transporting substance.

The constitution of the photosensitive layer of the present invention is not limited thereto naturally, and is described below in detail.

The charge-generating layer may be formed by applying onto an electroconductive support a coating liquid which has been prepared by dispersing the azo pigment of the formula (1) and a binder in a suitable solvent. The film thickness is preferably not more than 5 μm, more preferably in the range of from 0.1 to 1 μm.

The binder resin used may be selected from a great variety of insulating resins and organic photoconductive polymers. Preferred resins are polyvinylbutyrals, polyvinylbenzals, polyarylates, polycarbonates, polyesters, phenoxy resins, cellulose resins, acrylic resins, polyurethanes, and the like. The content of the binder resin in the charge-generating layer is preferably not more than 80% by weight, more preferably not more than 40% by weight.

Any solvent may be employed, provided that the solvent dissolves the above-mentioned resin. Specific examples of the resins include ethers such as tetrahydrofuran, and 1,4-dioxane; ketones such as cyclohexanone and methyl ethyl ketone; amides such as N,N-dimethylformamide; esters such as methyl acetate, and ethyl acetate; aromatic solvents such as toluene, xylene, and chlorobenzene; alcohols such as methanol, ethanol, and 2-propanol; aliphatic halogenated hydrocarbons such as chloroform, methylene chloride, dichloroethylene, carbon tetrachloride, and trichloroethylene; and the like. Among them, preferable are solvents which does not dissolve the charge-transporting layer nor the undercoat layer described later.

The azo pigment employed in the present invention may either be amorphous or be crystalline. Two or more of the azo pigments of the formula (1) may be combinedly used or the azo pigment may be used combinedly with a known charge-generating substance, if necessary.

The charge-transporting layer may be formed on or beneath the charge-generating layer, and has a function of receiving charge carriers from the charge-generating layer and transporting the carriers under an electric field applied.

The charge-transporting layer may be formed by applying a solution of a charge-transporting substance and if necessary, together with a suitable binder resin in a solvent. The film thickness if preferably in the range of from 5 to 40 μm, more preferably from 15 to 30 μm.

The charge-transporting substance includes electron-transporting substances and positive-hole-transporting substances. The examples of the electron-transporting substances are electron-attracting substances such as 2,4,7-trinitrofluorenone, 2,4,5,7-tetranitrofluorenone, chloranil, and tetracyanoquinodimethane; and polymers of these electron-attracting substances.

The positive-hole-transporting substances include polycyclic aromatic compounds such as pyrene and anthracene; heterocyclic compounds including carbazoles, indoles, imidazoles, oxazoles, thiazoles, oxadiazoles, pyrazoles, pyrazolines, thiadiazoles, and triazoles; hydrazone compounds such as p-diethylaminobenzaldehyde-N,N-diphenylhydrozone, and N,N-diphenylhydrazino-3-methylidene-9-ethylcarbazole; styryl compounds such as α-phenyl-4'-N,N-diphenylaminostilbene, and 5-[4-(di-p-tolylamino)benzylidene]-5H-dibenzo[a,d]cycloheptene; benzidines; triarylmethanes, triphenylamines; and the like; and polymers having a radical derived from the above compound in the main chain or side chain thereof such as poly-N-vinylcarbazole, polyvinylanthracene, etc.

In addition to these organic charge-transporting substances, inorganic materials such as selenium, selenium-tellurium, amorphous silicon, and cadmium sulfide may be used.

These charge-transporting substances may be used alone or in combination of two or more kinds thereof.

If the charge-transporting substance does not have a film-forming property, a suitable binder may be used. The specific examples of the binder include insulating resins such as acrylic resins, polyarylates, polyesters, polycarbonates, polystyrenes, acrylonitrile-styrene copolymers, polyacrylamides, polyamides, chlorinated rubbers, and the like; and organic photoconductive polymers such as poly-N-vinylcarbazole, polyvinylanthracene, and the like.

Another specific example of the present invention is an electrophotographic photosensitive member having a monolayer type photosensitive layer which contains the azo pigment of the formula (1) and a charge-transporting substance in the same layer. In this example, as the charge-transporting substance, a charge-transfer complex such as a combination of poly-N-vinylcarbazole and trinitrofluorenone may also be used.

As a protecting layer, a simple resin layer or a resin layer containing electroconductive particles or charge-transporting substance may be provided for the purpose of protecting the photosensitive layer from adverse mechanical and chemical influences in the present invention.

The electroconductive support may be made of a metal or alloy such as aluminum, aluminum alloy, copper, zinc, stainless steel, vanadium, molybdenum, chromium, titanium, nickel, indium, gold, and platinum. Further, the electroconductive support may be a plastic on which a film of the metal or metal alloy as mentioned above is formed by vacuum vapor deposition: the plastic including polyethylene, polypropylene, polyvinyl chloride, polyethylene terephthalate, acrylic resins, and the like; or may be a plastic or metal substrate which is coated with a mixture of electroconductive particles (such as carbon black particles, and silver particles) and a suitable binder, or a plastic or paper sheet impregnated with electroconductive particles.

An undercoat layer having a barrier function and an adhesive function may be provided between the electroconductive support and the photosensitive layer. The undercoat layer may be made of casein, polyvinyl alcohol, nitrocellulose, polyamides such as nylon 6, nylon 66, nylon 610, nylon copolymers, and alkoxymethylated nylon, polyurethanes, aluminum oxide, and the like. The thickness of the undercoat layer is preferably not more than 5 μm, more particularly in the range of from 0.1 to 3 μm.

The electroconductive support may be in a shape of a drum, a sheet, a belt, or the like.

The electrophotographic photosensitive member of the present invention in not only useful for electrophotographic copying machines but also useful for a variety of application fields including facsimiles, laser beam printers, CRT printers, LED printers, liquid crystal printers, laser engraving systems, and so forth.

FIG. 1 shows a schematic diagram of a usual transfer type electrophotographic apparatus employing the electrophotographic photosensitive member of the present invention.

In FIG. 1, a drum type photosensitive member 1 serves as an image carrier, being driven to rotate around the axis 1*a* in the arrow direction at a predetermined peripheral speed. The photosensitive member 1 is charged positively or negatively at the peripheral face uniformly during the rotation by an electrostatic charging means 2, and then exposed to image-exposure light L (e.g. slit exposure, laser beam-scanning exposure, etc.) at the exposure portion 3 with an image-exposure means (not shown in the figure), whereby electrostatic latent images are sequentially formed on the peripheral surface in accordance with the exposed image.

The electrostatic latent image is developed with a toner by a developing means 4, and the toner-developed images are sequentially transferred by a transfer means 5 onto a transfer-receiving material P which is fed between the photosensitive member 1 and the transfer means 5 synchronously with the rotation of the photosensitive member 1 from a transfer-receiving material feeder not shown in the figure.

The transfer-receiving material P having received the transferred image is separated from the photosensitive member surface, and introduced to an image fixing means 8 for fixiation of the image and discharged from the copying machine as a duplicate copy.

The surface of the photosensitive member 1, after the image transfer, is cleaned with a cleaning means 6 to remove any residual un-transferred toner, and is treated for electrostatic charge erasing means 7 for repeated use for image formation.

The generally and usually employed charging means 2 for uniformly charging the photosensitive member 1 is a corona charging apparatus. The generally and usually employed transfer means 5 is also a corona charging means. In the electrophotographic apparatus, two or more of the constitutional elements such as the above described photosensitive member, the developing means, the cleaning means, etc. may be integrated as one apparatus unit, which may be made mountable to or demountable from the main body of the apparatus. For example, at least one of a charging means, a developing means, and a cleaning means is combined with the photosensitive member into one unit mountable to or demountable from the main body of the apparatus by aid of a guiding means such as a rail of the main body of the apparatus. A charging means and/or a developing means may be combined with the aforementioned unit.

In the case where the electrophotographic apparatus is used as a copying machine or a printer, the optical image exposure light L is projected onto the photosensitive member as reflected light or transmitted light from an original, or otherwise projected onto the photosensitive member by signalizing information read out with a sensor from an original and then scanning with a laser beam, driving an LED array, or driving a liquid crystal shutter array according to the signal.

Figure 2:
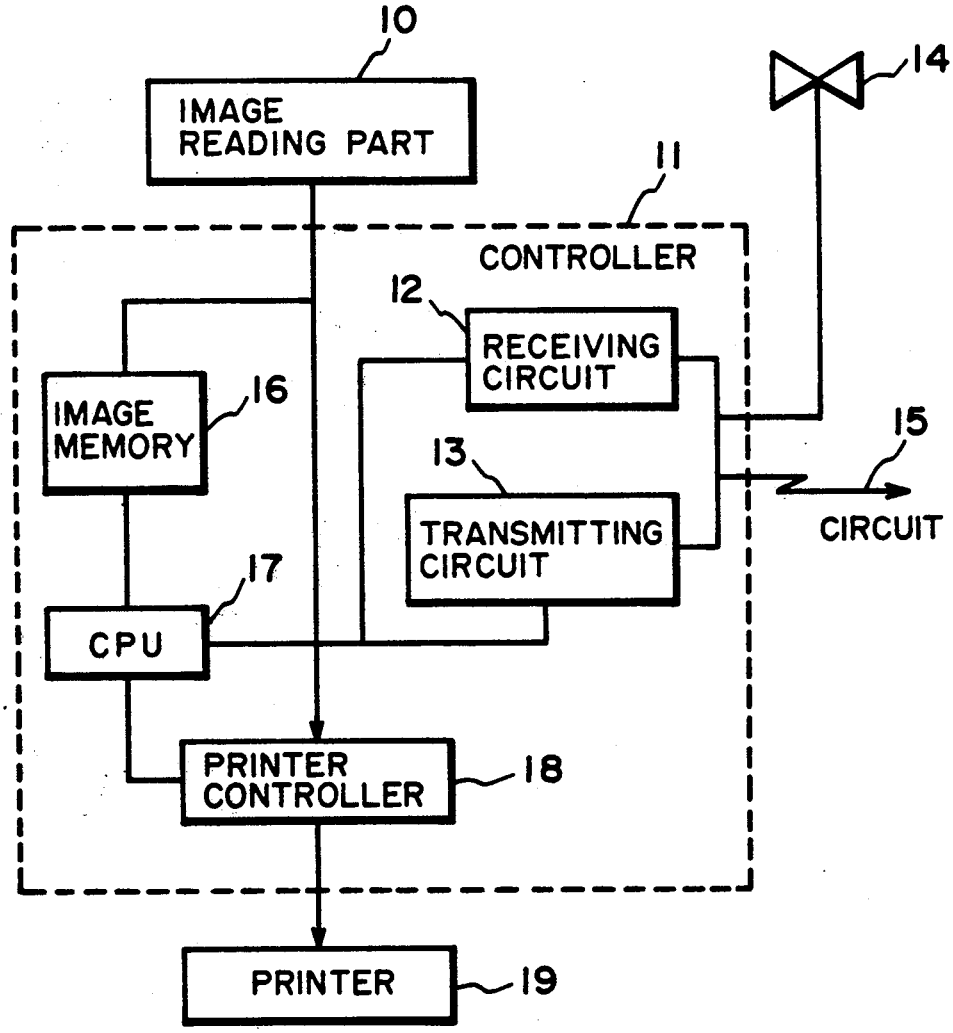
FIG. 2 illustrates an example of a block diagram of a facsimile employing the electrophotographic photosensitive member of the present invention.

In the case where the electrophotographic apparatus is used as a printer of a facsimile apparatus, the optical image exposure light L is for printing the received data. FIG. 2 is a block diagram of an example of this case.

A controller 11 controls an image reading part 10 and a printer 19. The whole of the controller 11 is controlled by a CPU 17. Readout data from the image reading part is transmitted through a transmitting circuit 13 to the other communication station. Data received from the other communication station is transmitted through a receiving circuit 12 to a printer 19. The image data is stored in image memory. A printer controller 18 controls a printer 19. The numeral 14 denotes a telephone set.

The image received through a circuit 15, namely image information from a remote terminal connected through the circuit, is demodulated by the receiving circuit 12, treated for decoding of the image information in CPU 17, and successively stored in the image memory 16. When at least one page of images are stored in the image memory 16, the images are recorded in such a manner that the CPU 17 read out the one page of image information, and send out the decoded one page of information to the printer controller 18, which controls the printer 19 on receiving the one page of information from CPU 17 to record the image information.

Incidentally the CPU 17 receives the following page of information while recording is conducted by the printer 19.

Images are received and recorded in the manner as described above.

EXAMPLE 1

Onto an aluminum substrate, a solution of 5 g of methoxymethylated nylon (weight-average molecular weight: 32,000) and 10 g of alcohol-soluble copolymer nylon (weight-average molecular weight: 29,000) in 95 g of methanol was applied with a Meyer bar to form a undercoat layer having a dry film thickness of 1 μm.

Separately, 5 g of the Exemplified pigment (2-1) was added to a solution of 2 g of a butyral resin (butyralation degree: 63 mol %) in 95 g of cyclohexanone, and was dispersed for 20 hours by means of a sand mill. The resulting dispersion was applied and dried on the aforementioned undercoat layer with a Meyer bar to give a charge-generating layer having a dry film thickness of 0.2 μm.

5 g of the hydrazone compound represented by the structural formula below:

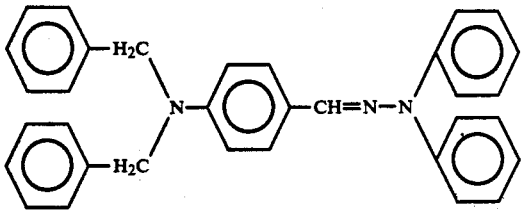

and 5 g of polymethyl methacrylate (number-average molecular weight: 100,000) were dissolved in 40 ml of toluene. The solution was applied onto the above-mentioned charge-generating layer with a Meyer bar and dried to form a charge-transporting layer having a dry film thickness of 20 μm.

The electrophotographic photosensitive member thus prepared was tested for charging characteristics by means of an electrostatic copying-paper tester (Model SP-428, made by Kawaguchi Denki K. K.) by subjecting the member to corona charging at −5 KV, leaving it in the dark for 1 second, and exposing it to light of illuminance of 10 lux.

The charging characteristics measured were the surface potential ($V_0$) immediately after the charging, and the quantity of light exposure ($E_{\frac{1}{2}}$) required for decay of the potential after 1 second of dark standing by half, namely sensitivity.

The results are shown in Table 1.

EXAMPLES 2-9

Electrophotographic photosensitive members were prepared and evaluated in the same manner as in Example 1 except that Exemplified pigment (2-2), (2-4), (2-7), (2-9), (2-13), (2-23), (3-1), and (3-4) were respectively used in place of Exemplified pigment (2-1).

The results are shown in Table 1.

TABLE 1

| Example | Exemplified pigment | $V_0$ (−V) | $E_{\frac{1}{2}}$ (lux.sec) |
|---|---|---|---|
| 1 | (2-1) | 710 | 2.0 |
| 2 | (2-2) | 705 | 1.8 |
| 3 | (2-4) | 695 | 3.9 |
| 4 | (2-7) | 700 | 3.3 |
| 5 | (2-9) | 680 | 2.1 |
| 6 | (2-13) | 715 | 3.2 |
| 7 | (2-23) | 690 | 4.5 |
| 8 | (3-1) | 720 | 2.3 |
| 9 | (3-4) | 710 | 2.5 |

COMPARATIVE EXAMPLES 1-3

Electrophotographic photosensitive members were prepared and evaluated for charging characteristics in the same manner as in Example 1 except that Comparative pigments (A) to (C) represented by the structural formulas below were used respectively in place of the azo pigment employed in Example 1.

The results are shown in Table 2.

Comparative pigment (A)

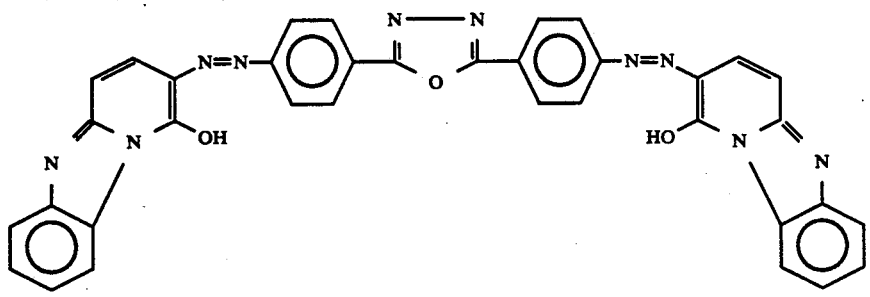

Comparative pigment (B)

-continued

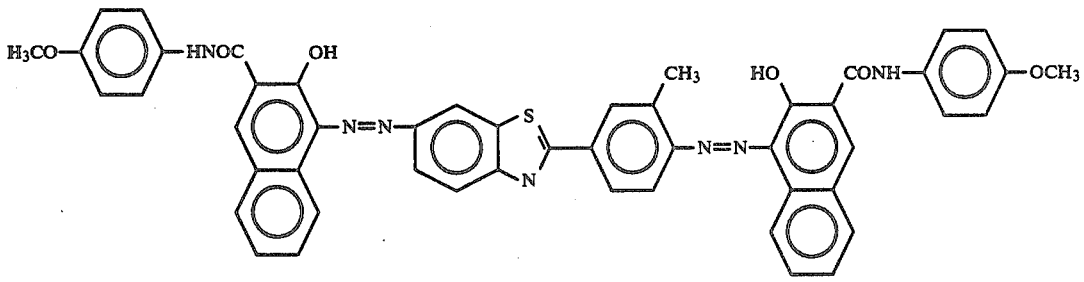

Comparative example (C)

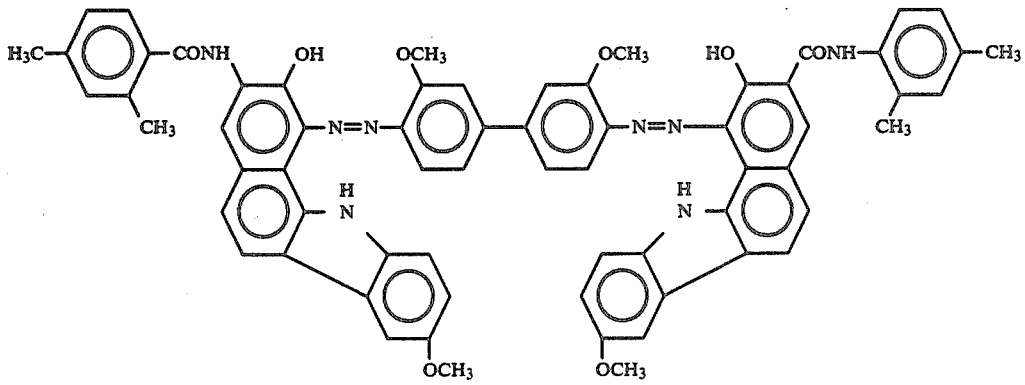

TABLE 2

| Comparative example | Exemplified pigment | $V_0$ (−V) | $E_{\frac{1}{2}}$ (lux.sec) |
|---|---|---|---|
| 1 | (A) | 690 | 7.8 |
| 2 | (B) | 670 | 8.3 |
| 3 | (C) | 705 | 6.2 |

EXAMPLES 10-12

The electrophotographic photosensitive members prepared in Examples 1, 2, and 6 were sticked respectively onto a cylinder of a copying machine equipped with a −6.5 KV corona charger, a light-exposing system, a developer unit, a transfer-charger, a charge-erasing light-exposing system, and a cleaner. This copying machine has a constitution that images are formed on a transfer paper sheet as the cylinder drives.

With this copying machine, the dark portion potentials $V_D$ and light portion potential $V_L$ at the initial stage were set respectively at approximately −700 V and −200 V, and the changes of the dark-portion potentials ($\Delta V_D$) and of the light-portion potentials ($\Delta V_L$) after 5000 times of copying were measured for the respective photosensitive members. The results are shown in Table 3, where a negative value of the change of the potential means a decrease in the absolute value of the potential, and a positive value of the change of the potential means an increase thereof.

TABLE 3

| Example | $\Delta V_D$ (V) | $\Delta V_L$ (V) |
|---|---|---|
| 10 | −10 | 0 |
| 11 | −5 | +10 |
| 12 | 0 | +10 |

COMPARATIVE EXAMPLE 4-6

The electrophotographic photosensitive members prepared in Comparative examples 1-3 were subjected to measurement of the change of the potentials during repeated use in the same manner as in Example 10. The results are shown in Table 4.

TABLE 4

| Comparative example | $\Delta V_D$ (V) | $\Delta V_L$ (V) |
|---|---|---|
| 4 | −85 | +95 |
| 5 | −60 | +85 |
| 6 | −55 | +60 |

EXAMPLE 13

Onto an aluminum face of an aluminum-deposited polyethylene terephthalate film, an undercoat layer of polyvinyl alcohol of 0.5 μm thick was formed. Thereon, the dispersion of the disazo pigment employed in Example 1 was applied with a Meyer bar, and the applied layer was dried to give a charge-generating layer of 0.2 μm thick.

Subsequently, a solution of 5 g of the styryl compound of the structural formula below:

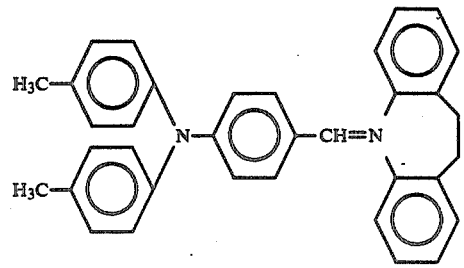

and 5 g of polyarylate (a polycondensate of bisphenol A and terephthalic acid-isophthalic acid) in 40 ml of tetrahydrofuran was applied on the charge-generating layer, and dried to form a charge-transporting layer of 20 μm thick. The electrophotographic photosensitive member thus prepared was tested for the charging properties and durability in the same manners as in Example 1 and Example 10. The results are as below.

$V_0$: −705 V
$E_{\frac{1}{2}}$: 2.3 lux.sec
$\Delta V_D$: −5 V
ΔVL: +10 V

EXAMPLE 14

An electrophotographic photosensitive member was prepared in the same manner as in Example 2 except that the charge-generating layer and the charge-transporting layer were applied in the reversed order. The resulting electrophotographic photosensitive member was evaluated for charging characteristics in the same manner as in Example 1 but employing a positive charge:

$V_0$: +690 V
$E_{\frac{1}{2}}$: 4.3 lux.sec

EXAMPLE 15

On the charge-generating layer prepared in Example 2, a solution of 5 g of 2,4,7-trinitro-9-fluorenone and 5 g of poly-4,4'-dioxydiphenyl-2,2-propane carbonate (molecular weight 300,000) in 70 ml of chlorobenzene was applied and dried to give a charge-transporting layer of 15 μm thick.

The charging characteristics of the resulting electrophotographic photosensitive member was evaluated in the same manner as in Example 1 but employing positive charging potentials.

$V_0$: +695 V
$E_{\frac{1}{2}}$: 5.1 lux.sec

EXAMPLE 16

0.5 g of Exemplified pigment (2-2) was dispersed in 9.5 g of cyclohexanone by means of a paint shaker for 5 hours. Thereto, a solution of 5 g of the charge-transporting substance used in Example 1 and 5 g of the polycarbonate in 40 g of tetrahydrofuran was added, and the mixture was shaken for further one hour. The coating solution prepared thus was applied onto an aluminum support with a Meyer bar and was dried to form a photosensitive layer of 20 μm thick.

The electrophotographic photosensitive member prepared thus was evaluated for charging characteristics in the same manner as in Example 1 but employing positive charge potentials.

$V_0$: +685 V
$E_{\frac{1}{2}}$: 4.2 lux.sec

EXAMPLE 17

5 g of 2,4,7-trinitro-9-fluorenone and 5 g of poly-N-vinylcarbazole (number-average molecular weight: 300,000) were dissolved in 70 ml of tetrahydrofuran to prepare a charge-transfer complex. This charge-transfer complex was added to a solution of 1 g of Exemplified pigment (2-5) and 5 g of polyester (trade name: Vylon, made by Toyobo Co., Ltd.) in 70 ml of tetrahydrofuran, and the mixture was dispersed. The resulting liquid dispersion was applied on an undercoat layer prepared in the same manner as in Example 1, and dried to form a photosensitive layer of 16 μm thick.

The charging characteristics of the electrophotographic photosensitive member prepared thus were evaluated in the same manner as in Example 1 but employing positive charging potentials.

$V_0$: +680 V
$E_{\frac{1}{2}}$: 4.7 lux.sec

What is claimed is:

1. An electrophotographic photosensitive member comprising an electroconductive support and a photosensitive layer formed thereon, the photosensitive layer containing a compound represented by the general formula (1) below:

$$Ar\text{-}(N{=}N{-}Cp)_i \quad (1)$$

wherein Ar is (a) a substituted or unsubstituted aromatic hydrocarbon radical which may be linked through a linking group or (b) a substituted or unsubstituted aromatic heterocyclic radical which may be linked through a linking group; Cp is a coupler radical having a phenolic hydroxyl radical; and i is 1, 2, 3 or 4; at least one of Cp is a coupler radical represented by the formula (2) below:

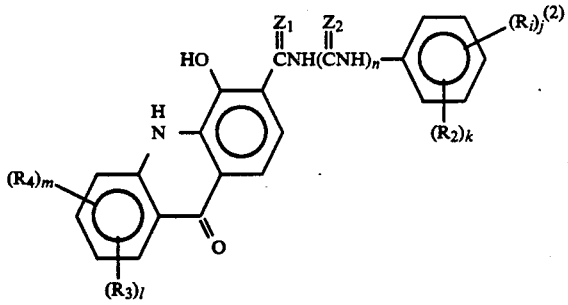

wherein $R_1$, $R_2$, $R_3$ and $R_4$ are the same or different, and are each hydrogen, alkoxy, disubstituted amino, halogen, nitro, cyano, trifluoromethyl, substituted or unsubstituted alkyl, substituted or unsubstituted aryl, or substituted or unsubstituted aralkyl; $Z_1$ and $Z_2$ are the same or different, and are each oxygen or sulfur; j and k are each 1, 2, 3, 4 or 5; l and m are each an 1, 2, 3, or 4; and n is 0 or 1.

2. An electrophotographic photosensitive member according to claim 1, wherein the compound of the formula (1) is the one represented by the formula (3) below:

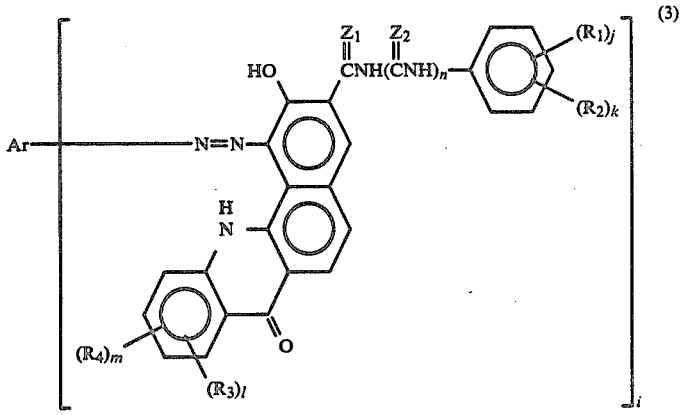

wherein Ar, $R_1$ to $R_4$, $Z_1$, $Z_2$, i to n are the same as in claim 1.

3. An electrophotographic photosensitive member according to claim 1, wherein at least one substituent selected from $R_1$, $R_2$, $R_3$, and $R_4$ is an electron-accepting group.

4. An electrophotographic photosensitive member according to claim 1, wherein the photosensitive layer comprises a charge-generating layer and a charge-transporting layer.

5. An electrophotographic photosensitive member according to claim 4, wherein the charge-transporting layer is overlaid on the charge-generating layer.

6. An electrophotographic photosensitive member according to claim 4, wherein the charge-generating layer is overlaid on the charge-transporting layer.

7. An electrophotographic photosensitive member according to claim 1, wherein the photosensitive layer is constituted of a single layer.

8. An electrophotographic photosensitive member according to claim 1, wherein an undercoat layer is provided between the electroconductive support and the photosensitive layer.

9. An electrophotographic photosensitive member according to claim 1, wherein a protective layer is provided on the photosensitive layer.

10. An electrophotographic apparatus comprising an electrophotographic photosensitive member, a means for forming an electrostatic latent image, a means for developing the electrostatic latent image formed, and a means for transferring the image developed onto a transfer-receiving material; the electrophotographic photosensitive member comprising an electroconductive support and a photosensitive layer formed thereon, and the photosensitive layer containing a compound represented by the general formula (1) below:

$$Ar\text{-}(N{=}N{-}Cp)_i \quad (1)$$

wherein Ar is (a) a substituted or unsubstituted aromatic hydrocarbon radical which may be linked through a linking group or (b) a substituted or unsubstituted aromatic heterocyclic radical which may be linked through a linking group; Cp is a coupler radical having a phenolic hydroxyl radical; and i is 1, 2, 3 or 4; at least one of Cp is a coupler radical represented by the formula (2) below:

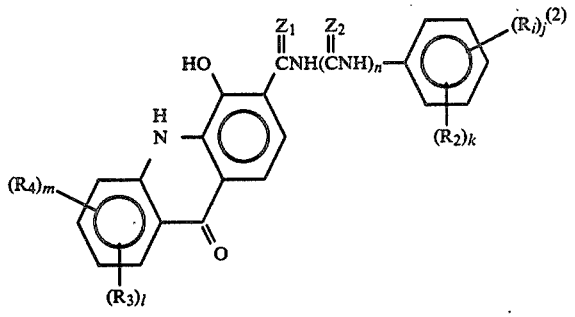

wherein $R_1$, $R_2$, $R_3$ and $R_4$ are the same or different, and are each hydrogen, alkoxy, disubstituted amino, halogen, nitro, cyano, trifluoromethyl, substituted or unsubstituted alkyl, substituted or unsubstituted aryl, or substituted or unsubstituted aralkyl; $Z_1$ and $Z_2$ are the same or different, and are each oxygen or sulfur; j and k are each 1, 2, 3, 4 or 5; l and m are each 1, 2, 3, or 4; and n is 0 or 1.

11. A device unit comprising an electrophotographic photosensitive member, a charging means, and a cleaning means; the electrophotographic photosensitive member comprising an electroconductive support and a photosensitive layer formed thereon, the photosensitive layer containing a compound represented by the general formula (1) below:

$$Ar\text{-}(N{=}N{-}Cp)_i \quad (1)$$

wherein Ar is (a) a substituted or unsubstituted aromatic hydrocarbon radical which may be linked through a linking group or (b) a substituted or unsubstituted aromatic heterocyclic radical which may be linked through a linking group; Cp is a coupler radical having a phenolic hydroxyl radical; and i is 1, 2, 3 or 4; at least one of Cp is a coupler radical represented by the formula (2) below:

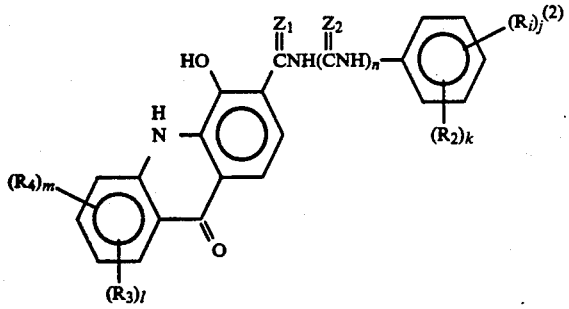

wherein $R_1$, $R_2$, $R_3$ and $R_4$ are the same or different, and are each hydrogen, alkoxy, disubstituted amino, halogen, nitro, cyano, trifluoromethyl, substituted or unsubstituted alkyl, substituted or unsubstituted aryl, or substituted or unsubstituted aralkyl; $Z_1$ and $Z_2$ are the same or different, and are each oxygen or sulfur; j and k are each 1, 2, 3, 4 or 5; l and m are each 1, 2, 3, or 4; and n is 0 or 1; said device unit integrating the electrophotographic photosensitive member, the charging means and the cleaning means in a single unit, which device unit is detachably mounted in an electrophotographic apparatus.

12. A device unit according to claim 11, wherein the device unit comprises a developing means.

13. A facsimile machine comprising an electrophotographic apparatus and a means for receiving image information from a remote terminal, the electrophotographic apparatus comprising an electrophotographic photosensitive member, the electrophotographic photosensitive member comprising an electroconductive support and a photosensitive layer formed thereon, the photosensitive layer containing a compound represented by the general formula (1) below:

$$Ar{-}N{=}N{-}Cp)_i \qquad (1)$$

wherein Ar is (a) a substituted or unsubstituted aromatic hydrocarbon radical which may be linked through a linking group or (b) a substituted or unsubstituted aromatic heterocyclic radical which may be linked through a linking group; Cp is a coupler radical having a phenolic hydroxyl radical; and i is 1, 2, 3 or 4; at least one of Cp is a coupler radical represented by the formula (2) below:

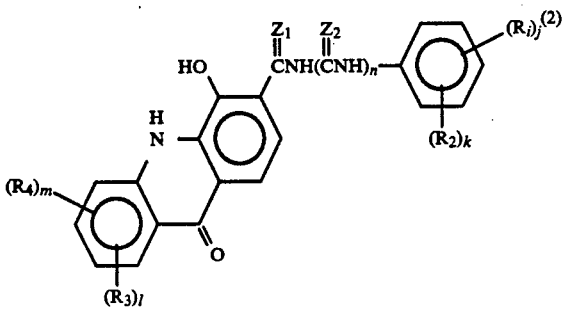

wherein $R_1$, $R_2$, $R_3$ and $R_4$ are the same or different, and are each hydrogen, alkoxy, disubstituted amino, halogen, nitro, cyano, trifluoromethyl, substituted or unsubstituted alkyl, substituted or unsubstituted aryl, or substituted or unsubstituted aralkyl; $Z_1$ and $Z_2$ are the same or different, and are each oxygen or sulfur; j and k are each 1, 2, 3, 4 or 5; l and m are each 1, 2, 3, or 4; and n is 0 or 1.

* * * * *

UNITED STATES PATENT AND TRADEMARK OFFICE

CERTIFICATE OF CORRECTION

PATENT NO. : 5,194,355

DATED : March 16, 1993

INVENTOR(S) : SATOMI OHMURA ET AL.

It is certified that error appears in the above-identified patent and that said Letters Patent is hereby corrected as shown below:

COLUMN 2

Form (2),

"

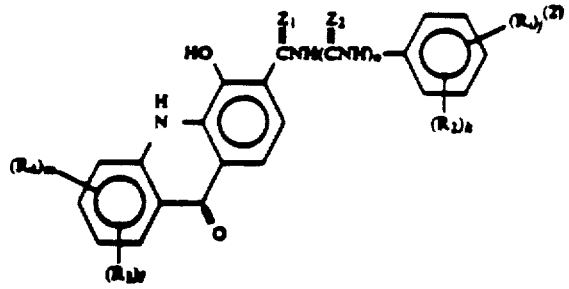

"

should read

--

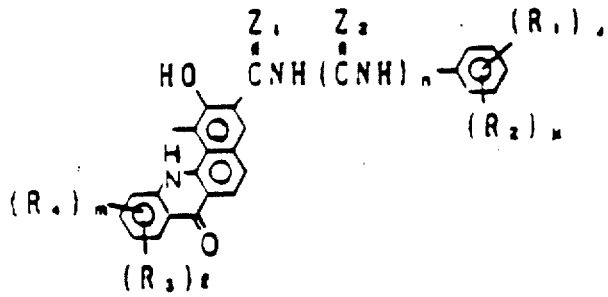

(2) --.

UNITED STATES PATENT AND TRADEMARK OFFICE

CERTIFICATE OF CORRECTION

PATENT NO. : 5,194,355

DATED : March 16, 1993

INVENTOR(S) : SATOMI OHMURA ET AL.

It is certified that error appears in the above-identified patent and that said Letters Patent is hereby corrected as shown below:

COLUMN 3

Form (2),

"

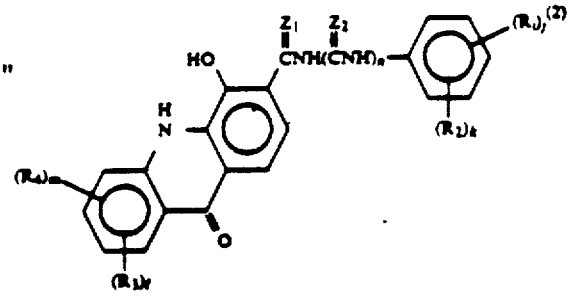

"

should read

--

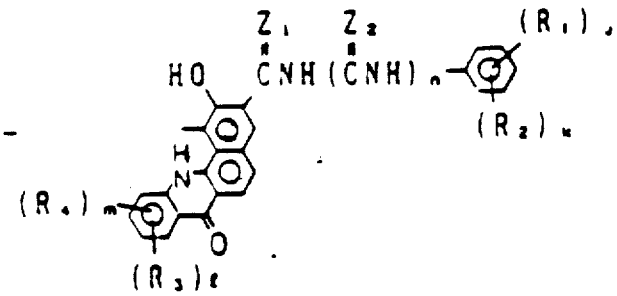

(2) --.

Line 64, "cyano, and halomethyl." (second occurrence) should be deleted.

UNITED STATES PATENT AND TRADEMARK OFFICE

CERTIFICATE OF CORRECTION

PATENT NO. : 5,194,355

DATED : March 16, 1993

INVENTOR(S) : SATOMI OHMURA ET AL.

It is certified that error appears in the above-identified patent and that said Letters Patent is hereby corrected as shown below:

COLUMN 4

Line 3, "dietylamino;" should read --diethylamino;--.

COLUMN 5

Line 22, "o'-naphthy-" should read --o-naphthy- --.

COLUMM 25

Line 31, "component" should read --components--.

COLUMN 26

Line 23, "does" should read --do--.
Line 40, "if" should read --is--.

COLUMN 29

Line 19, "a" (second occurrence) should read --an--.

UNITED STATES PATENT AND TRADEMARK OFFICE

CERTIFICATE OF CORRECTION

PATENT NO. : 5,194,355

DATED : March 16, 1993

INVENTOR(S) : SATOMI OHMURA ET AL.

It is certified that error appears in the above-identified patent and that said Letters Patent is hereby corrected as shown below:

COLUMN 34

Form (2),

"

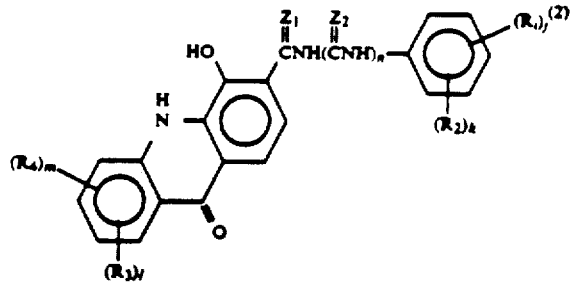

"

should read

--

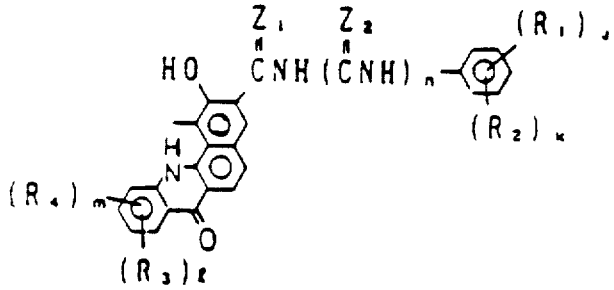

(2) --.

Line 61, "an" should be deleted.

UNITED STATES PATENT AND TRADEMARK OFFICE

CERTIFICATE OF CORRECTION

PATENT NO. : 5,194,355

DATED : March 16, 1993

INVENTOR(S) : SATOMI OHMURA ET AL.

It is certified that error appears in the above-identified patent and that said Letters Patent is hereby corrected as shown below:

COLUMN 36

Form (2),

"

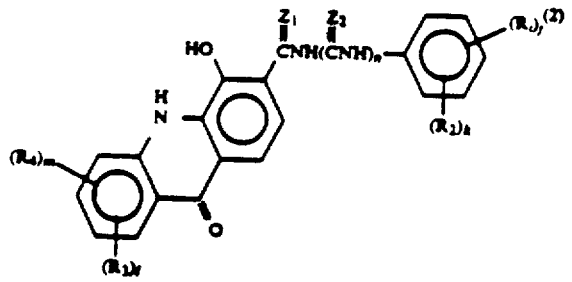

"

should read

--

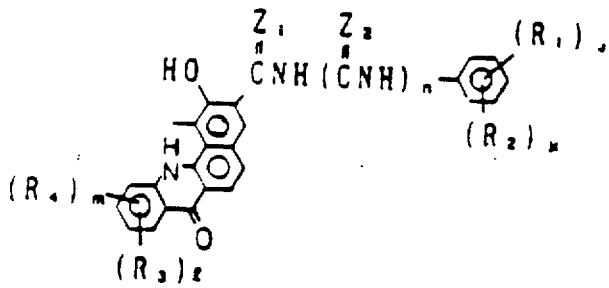

(2) --.

UNITED STATES PATENT AND TRADEMARK OFFICE

CERTIFICATE OF CORRECTION

PATENT NO. : 5,194,355

DATED : March 16, 1993

INVENTOR(S) : SATOMI OHMURA ET AL.

It is certified that error appears in the above-identified patent and that said Letters Patent is hereby corrected as shown below:

COLUMN 37

Form (2),

"

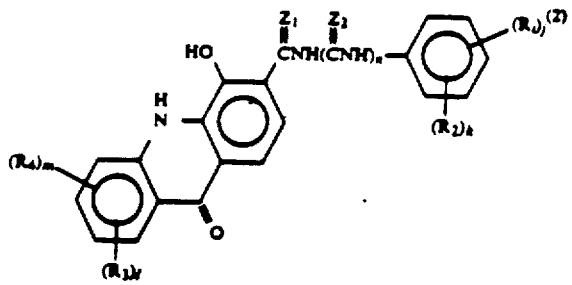

"

should read

--

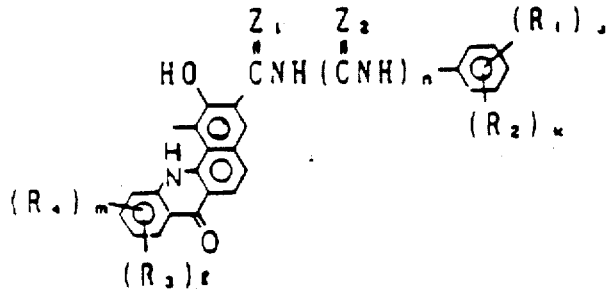

(2) --.

UNITED STATES PATENT AND TRADEMARK OFFICE

CERTIFICATE OF CORRECTION

PATENT NO. : 5,194,355

DATED : March 16, 1993

INVENTOR(S) : SATOMI OHMURA ET AL.

It is certified that error appears in the above-identified patent and that said Letters Patent is hereby corrected as shown below:

COLUMN 38

Form (2),

"

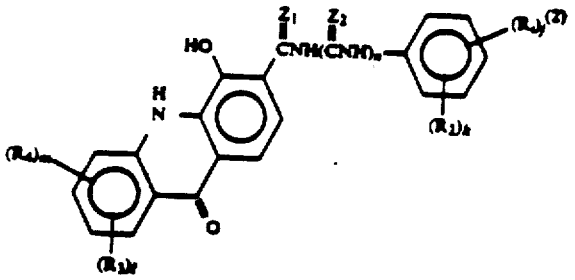

"

UNITED STATES PATENT AND TRADEMARK OFFICE

CERTIFICATE OF CORRECTION

PATENT NO. : 5,194,355

DATED : March 16, 1993

INVENTOR(S) : SATOMI OHMURA ET AL.

It is certified that error appears in the above-identified patent and that said Letters Patent is hereby corrected as shown below:

COLUMN 38

Form (2)

should read

-- 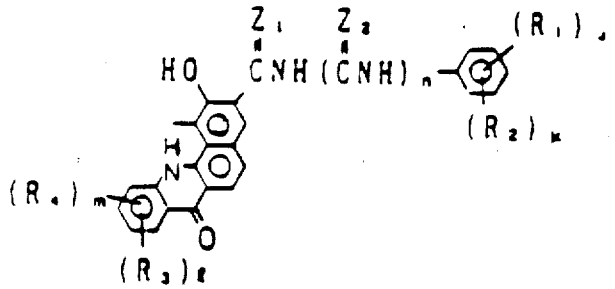 (2) --.

Signed and Sealed this

Eighth Day of February, 1994

Bruce Lehman

*Attest:*

BRUCE LEHMAN

*Attesting Officer*

*Commissioner of Patents and Trademarks*